US010094633B2

(12) United States Patent
Bertschinger et al.

(10) Patent No.: US 10,094,633 B2
(45) Date of Patent: Oct. 9, 2018

(54) SILENCER DEVICE

(71) Applicants: Werner Bertschinger, Duernten (CH); Hugo Ziegler, Altendorf (CH)

(72) Inventors: Werner Bertschinger, Duernten (CH); Hugo Ziegler, Altendorf (CH)

( * ) Notice: Subject to any disclaimer, the term of this patent is extended or adjusted under 35 U.S.C. 154(b) by 11 days.

(21) Appl. No.: 15/040,845

(22) Filed: Feb. 10, 2016

(65) Prior Publication Data

US 2016/0238335 A1 Aug. 18, 2016

(30) Foreign Application Priority Data

Feb. 11, 2015 (EP) ..... 15000400

(51) Int. Cl.
*F41A 21/30* (2006.01)

(52) U.S. Cl.
CPC ..... *F41A 21/30* (2013.01)

(58) Field of Classification Search
CPC ..... F41A 21/00; F41A 21/30; F41A 21/32; F41A 21/325; F41A 21/34; F41A 21/36
USPC ..... 89/14.3, 14.2, 14.4; 181/223
See application file for complete search history.

(56) References Cited

U.S. PATENT DOCUMENTS 4,570,529 A * 2/1986 A'Costa ..... F41A 21/34 42/78
4,584,924 A * 4/1986 Taguchi ..... F41A 21/30 181/223
5,136,924 A * 8/1992 Forster ..... F41A 21/30 89/14.4
5,596,161 A * 1/1997 Sommers ..... F41A 21/34 89/14.2
5,631,438 A * 5/1997 Martel ..... F41A 21/36 42/79
6,308,609 B1 * 10/2001 Davies ..... F41A 21/30 181/223
6,374,718 B1 * 4/2002 Rescigno ..... F41A 21/30 89/14.4
7,931,118 B1 * 4/2011 Cronhelm ..... F41A 21/30 181/223

(Continued)

FOREIGN PATENT DOCUMENTS

DE 679509 C 8/1939
DE 102013107115 A1 8/2014

(Continued)

OTHER PUBLICATIONS

Search Report from EPO, dated May 27, 2015.

*Primary Examiner* — Jonathan C Weber
(74) *Attorney, Agent, or Firm* — Johnson, Marcou & Isaacs, LLC; Jennifer S. Stachniak

(57) ABSTRACT

A silencer device for a firearm has a center portion including at least two substantially semi-circular chamber partition wall elements being spaced from one another in the longitudinal direction of the center portion, a housing portion into which the center portion is introduced, wherein between the at least two substantially semi-circular chamber partition wall elements and the inner wall of the housing portion at least one chamber is formed; and a positioning portion being at least connectable to the housing portion. The at least two substantially semi-circular chamber partition wall elements respectively comprise on their outer sides at least one chamfer, which form a lateral passage for explosive gases with the inner wall of the housing portion.

19 Claims, 9 Drawing Sheets

(56) References Cited

U.S. PATENT DOCUMENTS 8,167,084 B1 * 5/2012 Moore ..... F41A 21/30 181/223
8,453,789 B1 * 6/2013 Honigmann ..... F41A 21/30 181/223
8,459,405 B1 * 6/2013 Dueck ..... F41A 21/30 181/223
8,459,406 B1 * 6/2013 Dueck ..... F41A 21/30 181/223
8,505,680 B2 * 8/2013 Dueck ..... F41A 21/325 181/223
8,522,662 B2 * 9/2013 Presz, Jr. ..... F41A 13/08 181/223
8,528,691 B1 * 9/2013 Carmichael ..... F41A 21/30 181/223
8,910,745 B2 * 12/2014 Latka ..... F41A 21/30 181/223
8,950,310 B2 * 2/2015 Storrs ..... F01N 3/02 181/223
8,950,546 B2 * 2/2015 Shults ..... F41A 21/30 181/223
9,097,482 B1 * 8/2015 Holden ..... F41A 21/30
9,395,136 B1 * 7/2016 Kovalov ..... F41A 21/30
2011/0067950 A1 * 3/2011 Shults ..... F41A 21/30 181/223
2012/0152093 A1 * 6/2012 Koumbis ..... F41A 21/30 89/14.4
2013/0180796 A1 * 7/2013 Dueck ..... F41A 21/30 181/223
2013/0180797 A1 * 7/2013 Dueck ..... F41A 21/30 181/223
2013/0312592 A1 * 11/2013 Storrs ..... F01N 3/02 89/14.1
2014/0231168 A1 * 8/2014 Dueck ..... F41A 21/325 181/223
2014/0318887 A1 * 10/2014 Latka ..... F41A 21/30 181/223
2015/0362276 A1 * 12/2015 Fischer ..... F41G 11/003 89/14.4

FOREIGN PATENT DOCUMENTS

WO 9407103 A1 3/1994
WO 9603612 A1 2/1996
WO 2014127831 A1 8/2014

* cited by examiner

SILENCER DEVICE

CROSS-REFERENCE TO RELATED APPLICATIONS

The instant application claims the priority date of Feb. 11, 2015, the filing date of the European patent application 15 000 400.0.

BACKGROUND OF THE INVENTION

The invention relates to a silencer device for a one- or two-barrel firearm, in particular a shotgun.

As general background, a silencer for firearms which is adaptable to different sorts of ammunition is known from WO 94/07103. In this regard, a positioning piece is provided which may be mounted at the muzzle of the firearm, an end piece which comprises a shoot-out opening, or exit opening for the shot load, as well as a center piece which is arranged between the positioning piece and the end piece and which comprises a number of successively aligned chamber parts, each of which comprises a shoot-through opening, or an opening through which the shot load travels. Thereby, each chamber part is mounted, in accordance with the modular principle, directly at the neighbouring chamber part and the outer walls of the successive chamber parts form the silencer outer wall.

SUMMARY OF THE INVENTION

The object of the present invention is to provide a specific chamber configuration for a silencer device, by means of which efficient conducting of the explosive gases within the silencer device—and thus a particularly efficient sound insulation—can be achieved.

According to the invention, this object is solved by a silencer device for a firearm, in particular a shotgun, having a center portion including at least two substantially semi-circular chamber partition wall elements which are spaced from one another in the longitudinal direction of the center portion, the chamber partition wall elements respectively comprising a shoot-through opening, that is, an opening through which the shot load travels, wherein the shoot-through openings are correspondingly aligned with one another; a housing portion into which the center portion is introduced, wherein between the at least two substantially semi-circular chamber partition wall elements and the inner wall of the housing portion at least one chamber is formed; and a positioning portion being at least connectible to the housing portion and preferably being lockable at the muzzle of the firearm; wherein the at least two is substantially semi-circular chamber partition wall elements, respectively comprise at their outsides at least one chamfer, the at least one chamfer respectively forming together with the inner wall of the housing portion a lateral passage for explosive gases, and wherein the center portion comprises a longitudinal plate-shaped base element from which the substantially semi-circular chamber partition wall elements protrude.

The inventive silencer device is preferably applied for shotguns, in particular over-and-under-shotguns and double-barreled-shotguns (side-by-side-shotguns). Generally, also an application for rifles and handguns is conceivable.

In accordance with the present invention, the center portion comprises a longitudinal, plate-shaped base element, from which the substantially semi-circular chamber partition wall elements protrude (i.e. for a one-barrel firearm in upward direction and in the case of a two-barrel firearm, as for example an over-and-under-shotgun, in downward direction as well as in upward direction or in the case of a side-by-side-shotgun, to the left and to the right). The center portion may be formed in one piece (e.g. cast) or may be formed out of two (or more) center portion sections, which are connected to one another (e.g. welded), if applicable.

In a preferred embodiment of the present invention, the lateral passages are arranged alternatingly, wherein preferably, the alternatingly arranged lateral passages and the at least one chamber form a meander-shaped flow path for the explosive gases. Due to such a conducting of the explosive gases through the chambers of the silencer device, a particularly high sound insulation effect may be achieved. For shotguns, a sound dampening from approximately 140 dB to approximately 80 dB may be achieved in this manner.

"Alternatingly" means in the present case that the lateral chamfers of the chamber partition wall elements and accordingly, the lateral passages, are arranged alternatingly, that is, as viewed in the firing direction left, right, left etc. or right, left, right etc. For two-barrel firearms, for example, in the case of an over-and-under-shotgun, the center portion comprises at both sides of its longitudinal, preferably plate-shaped, base element—from which the chamber partition wall elements respectively protrude—respective chamfers or lateral passages. Preferably, these chamfers or lateral passages are oppositely arranged to the chamfers or lateral passages on the other side of the longitudinal base element. This means for an over-and-under-shotgun, that if (as viewed in the direction of firing) e.g. at the first chamber partition wall element for the upper barrel, the chamfer or the lateral passage is arranged on the left side of the silencer device, the chamfer or the lateral passage at the first chamber partition wall element for the lower barrel is arranged on the right side of the silencer device. However, an arrangement of the chamfers or lateral passages on the same side is also possible. The chamber partition wall elements for the upper end the lower barrel are thereby preferably arranged pairwise one above the other (i.e. in a plane transversely to the longitudinal axis) in order to ensure the best possible sound insulation effect. An offset arrangement in the longitudinal direction of the respective chamber partition wall elements for the upper and lower barrel (respectively left and right barrel) is also conceivable in principle.

In a further preferred embodiment of the present invention the (first) chamber partition wall element directly facing the positioning portion comprises, at least in sections, a thicker wall than the other chamber partition wall elements. This measure serves for absorbing the pressure introduced into the first chamber (i.e., which is formed between the first partition wall element and the positioning portion as an inlet chamber so to speak) and to thereby minimize the back-stroke of the firearm as far as possible. The wall, for example, may be step-like. Particularly preferred, however, the wall is formed as a (continuous) slope, wherein the slope is arranged on that side of the (first) chamber partition wall element facing the positioning portion. In a further preferred embodiment of the present invention, the slope (seen in a cross-section) encloses an angle a between 30° and 60°, preferably of about 45°, with the longitudinal base element of the center portion. In this way, the most effective back-stroke dampening may be achieved.

In a still further preferred embodiment of the present invention, the housing portion comprises a longitudinal flattening on its exterior. In this manner, a visual overlapping of the silencer device with the target device of the firearm, i.e. in case of a shotgun with a rail and a bead, may be reliably is prevented.

In a further preferred embodiment of the present invention, the positioning portion comprises at its side facing the center portion a recess which serves for receiving a narrow side of the longitudinal base element of the center portion. In this way, a particularly good mounting, respectively fastening, of the center portion to the positioning portion may be achieved.

In a still further preferred embodiment of the present invention, the positioning portion is formed flange-like in order to enable a flush placement of the housing portion. The regularly ring-shaped front side of the housing portion thereby abuts in a flush manner at the flange-ring of the positioning portion. The housing portion, the center portion as well as the positioning portion preferably comprise a round cross section, and more particularly preferred, comprises a circular cross-section.

In a further preferred embodiment of the present invention, the flange-like positioning portion comprises a mounting opening, preferably in the form of an open eight, which serves for mounting the silencer device to the muzzle(s) of the firearm, such that the barrel or barrels are aligned with the shoot-through openings of the chamber partition wall elements and such that further the rail and the bead may be received. Generally, the shoot-through openings of the chamber partition wall elements comprise the same diameter. It is however also conceivable that the shoot-through openings, as viewed in the firing direction, comprise diameters increasing in size.

In a further preferred embodiment of the present invention, the center portion comprises at its side facing away from the positioning portion an end-wall element with a shoot-out opening, or exit opening for the shot load, which is aligned correspondingly with the shoot-through openings of the at least two chamber partition wall elements. In this manner, a shot channel is formed. The shoot-out opening thereby preferably comprises the same diameter as the above mentioned shoot-through openings. It is however also conceivable that the shoot-out opening comprises a larger diameter than the shoot-through openings. In another embodiment of the invention, the end wall element may also be formed by the housing element. The end wall element regularly comprises a somewhat thicker wall than the chamber partition wall elements being arranged between the end wall element and the first chamber partition wall element.

In a still further preferred embodiment of the present invention, the end wall element of the center portion comprises bores which correspond with bores at the end of the housing portion facing away from the muzzle of the firearm. In this manner, an efficient mounting or fastening of the housing to element at the center portion may be ensured, for example, by means of pins, screws or similar fastening means.

Preferably, also the positioning portion comprises bores, which correspond with bores at the end of the housing portion facing the muzzle of the firearm and wherein preferably the positioning portion further comprises mounting bores by means of which the positioning portion may be mounted/locked at the muzzle of the firearm. In this manner, an efficient mounting or fastening of the housing element at the positioning portion as well as of the positioning portion at the muzzle of the firearm may be ensured, for example, by means of pins, screws or similar fastening means.

In a still further preferred embodiment of the present invention, the chamber partition wall elements, the end wall element and the positioning element form together with the inner wall of the housing portion a total of two to ten, preferably four to eight, and particularly preferred, six chambers. In this manner, the ideal length for the flow path of the explosive gas may be defined and thus the optimum sound insulation effect achieved. Thus, as viewed in the direction of firing, also the first chamber between the first chamber partition wall element and the positioning portion as well as the last chamber, as seen in the direction of firing, between the end wall element and the last chamber partition wall element count as chambers in the sense of the present invention. The first (inlet)-chamber, due to the slope by means of which the first partition wall element is provided, if applicable, may comprise a different form than other chambers of the silencer device.

The chamber partition wall elements are substantially semi-circular and formed correspondingly with the housing inner wall (i.e. apart from the chamfers). Further, the chamber partition wall elements, at both sides, arcuately merge into the base element of the center portion, such that in this is area, the foot area of the chamber partition wall elements, the wall thickens respectively. Preferably a horizontal area of the base element, respectively, is provided between the foot areas of two successive chamber partition wall elements. Embodiments in which the foot area of two successive chamber partition wall elements directly merge into one another are, however, also conceivable.

The center portion is usually formed as two-pieces, wherein the (second) center portion section, which comprises the end wall element, is introduced with its base element piece into a corresponding recess in the back side of the (first) center portion section which comprises the first chamber partition wall element. However, the center portion may—depending on the number of desired chambers—also comprise a respective multiple piece design. A one-piece design of the center portion is also conceivable. The one-piece design of the center portion is somewhat more costly in production, but particularly sturdy.

BRIEF DESCRIPTION OF THE DRAWINGS

Preferred embodiments of the present invention are shown in the attached drawings and provided as merely exemplary and to better illustrate the present invention.

In the drawings.

DETAILED DESCRIPTION OF THE PREFERRED EMBODIMENTS

Figure 1:
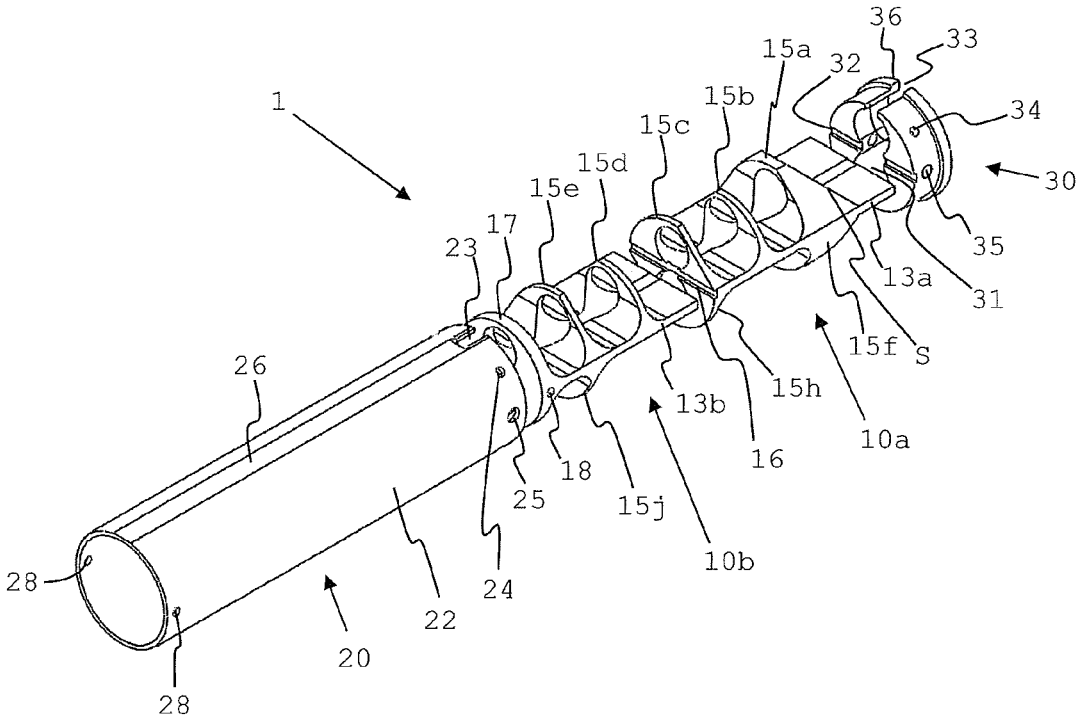
FIG. 1 shows an explosive view of an inventive silencer device for a firearm with two barrels arranged above one another.

FIG. 1 shows an inventive silencer device 1 in exploded view. As FIG. 1 shows, the inventive silencer device 1 consists of a sleeve-like housing portion 20, a first center portion section 10*a*, a second center portion section 10*b* as well as a flange-like positioning portion 30.

The flange-like positioning portion 30 comprises a flange ring 36 as well as a mounting opening 31, which in the present case is in the form of an open eight, with an (upper) gap 33. This design is applied for double-barreled is firearms. The positioning portion 30 serves substantially for attaching and for mounting the silencer device 1 onto the respective firearm. Mounting bores 35 are provided on the outer circumference of the flange-like positioning portion 30, which run horizontally between the two barrels of the firearm (here for example for an over-and-under-shotgun), in order to ensure a particularly secure locking.

A recess 32 extends substantially parallel to the mounting bores 35 on the front side of the flange-like positioning portion 30, the recess 32 being interrupted by the mounting opening 32.

Figure 2:
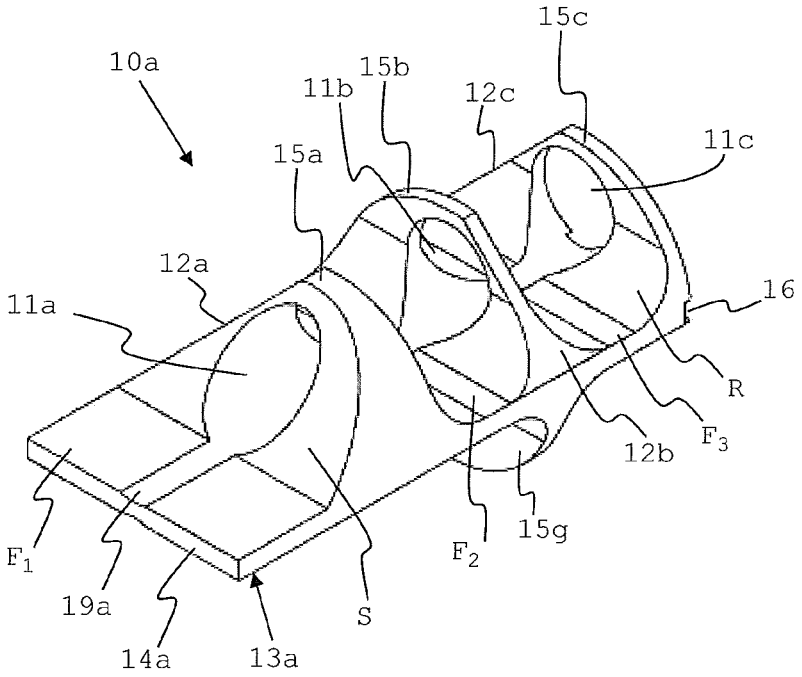
FIG. 2 shows a perspective view of a first center portion section for an inventive silencer device.

The recess 32 serves for connecting the positioning portion 30 with the first center portion section 10*a*. Further bores 34 are positioned at the outer circumference of the flange-like positioning portion 30, which serve for connecting or mounting the housing portion 20 to the positioning portion 30. As can be seen, the longitudinal base element 13*a* of the first center portion section 10*a*, and more particularly, the narrow side 14*a* of the latter (c.f. FIG. 2), is inserted into the recess 32 of the positioning portion 30 and fastened there in an appropriate manner (for example, welded).

The first center portion section 10*a* includes on the upper side of its longitudinal base element 13*b* chamber partition wall elements 15*a*, 15*b* and 15*c*, and on its backside a recess 16, which again serves for receiving the longitudinal base element 13*b* of the second center portion section 10*b* or of narrow side 14*b* thereof.

On the underside of the first center portion section 10*a*, further chamber partition wall elements 15*f*, 15*g* and 15*h* (here, 15*g* is covered) are arranged, the design of which is described in more detail below.

The second center portion section 10*b* again comprises on the upper side of its longitudinal base element 13*b* chamber partition wall elements 15*d* and 15*e*, and terminates with the end wall element 17 (which does not comprise any chamfers). The end wall element 17 terminates in the mounted state with the front end of the housing portion 20. On the underside of the first center portion section 10*a*, further chamber partition wall elements 15*e* and 15*j* (here, 15*i* is covered) are arranged, the design of which is described in more detail below.

The end wall element 17 comprises bores 18 at its outer circumference, which correspond with bores 28 at the front end of the housing portion 20 and which serve for later mounting of the two components.

On the outside 22 of the housing portion 20, a longitudinal flattening 26 is provided, which terminates into a recess 23. This design is provided, so that an adaptation with regard to the target device of the firearm (for example, rail and bead of a shotgun) may be achieved in the final mounted state (that is, when the silencer device 1 has been put onto a respective firearm).

The bores 24 and 25 at the rear end of the housing portion 20, where also the recess 23 is provided, on the one hand serve for the mounting of the housing portion 20 at the positioning portion 30 (bores 24, 34) and on the other hand for the mounting and locking at the barrel of the firearm (mounting bores 25, 35).

Further, one can see that the first chamber partition wall element 15*a* of the first center portion section 10*a* comprises a slope S extending in the direction of the positioning portion 30.

Next, with regard to FIG. 2, the first center portion section 10*a* is described in more detail. The longitudinal base element 13*a* of the first center portion section 10*a* includes narrow side 14*a* as well as on its upper side, the flat regions $F_1$, $F_2$ and $F_3$. Between the flat regions $F_1$ and $F_2$ the first chamber partition wall element 15*a* is arranged, which comprises a slope S extending in forward direction and which comprises insofar a thicker wall than the two other chamber partition wall elements 15*b* and 15*c*.

The first chamber partition wall element 15*a* also comprises on its left side a chamfer 12*a*, as viewed in the firing direction. A shoot-through opening 11*a* extends through the first chamber partition wall element 15*a*, that is, for the shotload of a shotgun. A groove 19 runs through the flat region $F_1$, the groove 19 initially terminating into the lower region of the shoot-through opening 11*a* and then respectively further extending to the opposite end of the longitudinal base element 13*a*. The groove 19*a* is provided in order to provide a precisely flush alignment with the mounting opening 31 of the positioning portion 30 as well as with the shoot-through opening 11*a* (and the further shoot-through openings) respectively with the (upper) barrel of the firearm, when the silencer device 1 has been put onto the muzzle of the firearm.

The further chamber partition wall elements 15*b* and 15*c* respectively comprise lateral chamfers 12*b* and 12*c*. The lateral chamfers 12*a*, 12*b* and 12*c* are thereby arranged alternatingly (here, as viewed in the firing direction from left to right and again to the left). The second chamber partition wall element 15*b* comprises a shoot-through opening 11*b* and the rear chamber partition wall element 15*c* a shoot-through opening 11*c*, wherein again the shoot-through openings are aligned in a flush manner with one another. By means of rear chamber partition wall element 15*c* one may recognize that the (thinner) chamber partition wall elements 15*b* and 15*c* (and the first chamber partition wall element 15*a* on its side facing away from the positioning portion 30) respectively comprise arcuate shaped, rounded foot regions R, which then merge into the flat regions $F_2$ or $F_3$, respectively.

On the back side of the first center portion section 10*a*, a recess 16 is provided, in which—as already mentioned above—the longitudinal base element 13*b* of the second center portion section 10*b* is inserted. On the underside of the longitudinal base element 13*a*, corresponding chamber partition wall elements 15*f*, 15*g* and 15*h* are provided for each of the upper chamber partition wall elements 15*a*, 15*b* and 15*c*. Only the center chamber partition wall element 15*g* may be seen here.

This is because the chamfers 12*f* and 12*h* of the two lower chamber partition wall elements 15*f* and 15*h* which are not visible, are arranged according to FIG. 2 on the right side, since also here the chamfers are arranged alternatingly—namely oppositely alternating with regard to the respective chamfers of the chamber partition wall elements 15*a*, 15*b* and 15*c* on the upper side of the longitudinal base element 13*a*.

Figure 3:
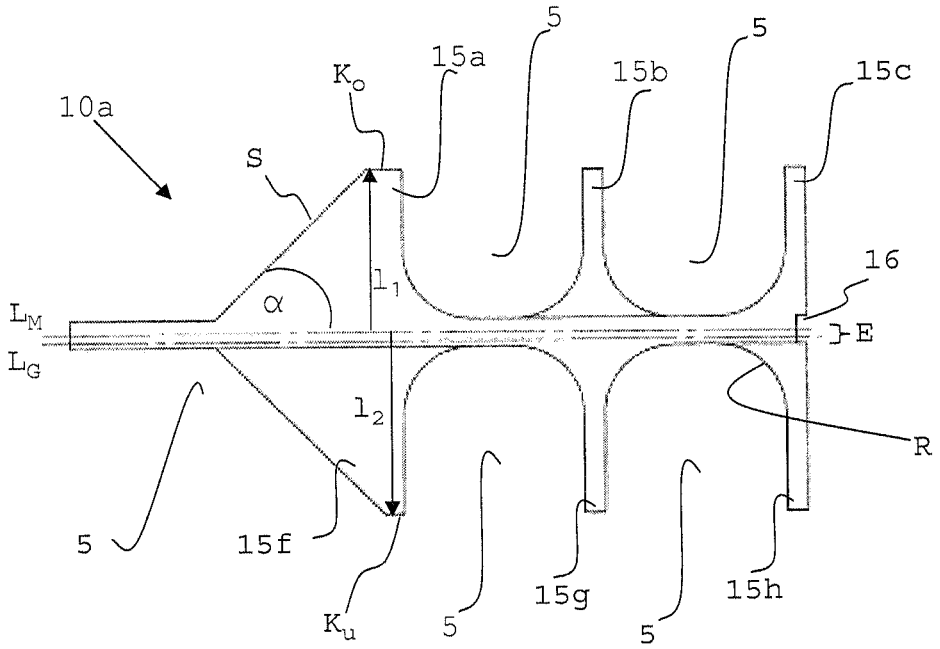
FIG. 3 shows a side view of the first center portion section according to FIG. 2.

FIG. 3 illustrates a side view of the first center portion section 10*a*. Here, one may recognize in particular on the underside of the first center portion section 10*a* the lower chamber partition wall elements 15*f*, 15*g* and 15*h*, which are respectively formed oppositely (that is,. from the longitudinal axis $L_M$) with regard to the upper chamber partition wall elements 15*a*, 15*b* and 15*c*.

Also, here one may well recognize how the arcuately rounded foot regions R of the respective chamber wall partition elements merge into the flat regions. The chamber partition wall elements 15*a* (top) and 15*f* (bottom), respectively, comprise a slope S and insofar have a thicker wall than the remaining chamber partition wall elements 15*b*, 15*c*, 15*g* and 15*h*. The slope S includes with the longitudinal axis $L_M$ of the first center portion section 10*a* an angle $\alpha$ of 30 to 60°, preferably approximately 45°. In this manner, the pressure which is created during the shot may be absorbed well and a particularly efficient backstroke dampening may be achieved.

Further, one can see that the distance from the longitudinal axis $L_M$ of the first center portion section 10*a* to the upper edge $K_O$ corresponds to the length $L_1$ and the distance from the longitudinal access $L_M$ of the first center portion section 10*a* to the lower edge of the lower chamber partition wall elements 15*f* corresponds to the length $L_2$.

In a preferred embodiment of the present invention, the length $L_2$ is bigger than the length $L_1$. The length $L_2$ is regularly bigger by the amount which corresponds to the distance between the longitudinal axis $L_M$ of the first center portion section 10*a* and the longitudinal axis $L_G$ of the housing portion 20. The eccentricity E resulting herefrom serves for equalizing the dimensioning of the positioning portion 30 (in particular, with regard to the gap 33 for mounting onto the firearm).

This, however, represents a preferred embodiment of the present invention; solutions without eccentricity are also conceivable.

One can further see that the upper edge of the chamber partition wall element 15*a* is broader than the lower edge of the respective (lower) chamber partition wall element 15*f*. This is because the upper chamber partition wall element 15*a* comprises the smaller length $l_1 < l_2$ with regard to the lower chamber partition wall element 15*f* (and has therefore been cut-off earlier so to speak). Between the respective chamber partition wall elements 15*a* and 15*b*, 15*b* and 15*c*, 15*f* and 15*g* and 15*g* and 15*h*, chambers 5 are respectively formed, which together with the chamfers 12*a, b, c, f, g, h* form an upper and a lower flow path P for the explosive gases which are created during a shot. Due to the configuration of the flow path P, the inventive silencer device 1 may achieve a particularly high sound dampening effect (approximately from 140 dB to approximately 80 dB for shotguns, i.e. a $\Delta$ of approximately 60 dB).

Figure 4:
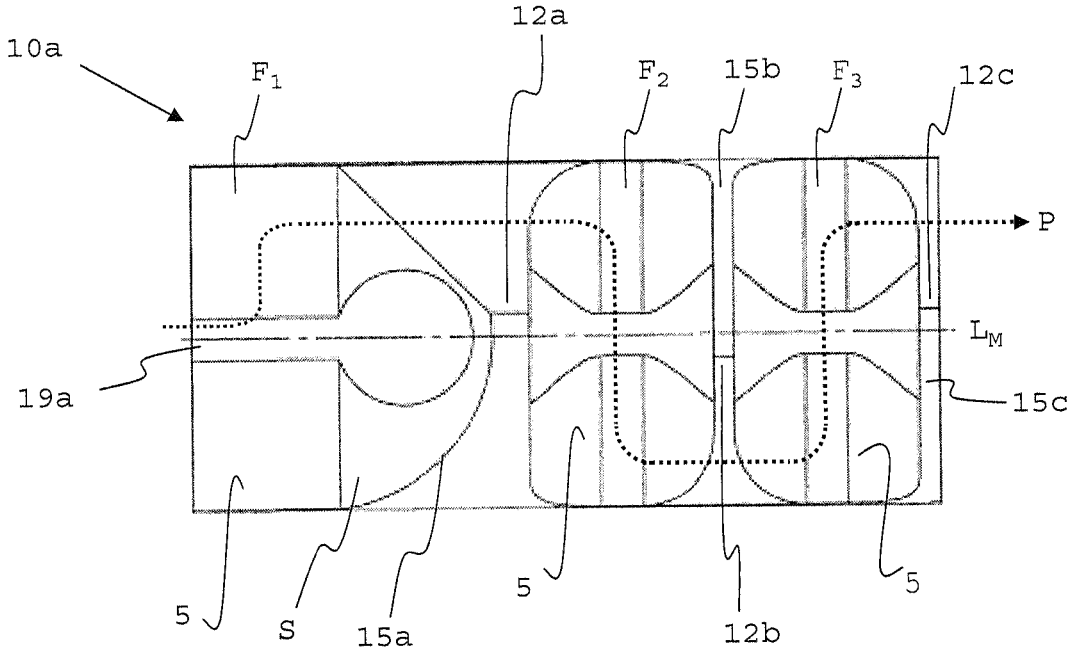
FIG. 4 shows a top view onto the first center portion section according to FIG. 2.

The flow path P is schematically illustrated in FIG. 4 by means of a top view on a first center portion section 10*a* of the inventive silencer device 1. As can be seen, the explosive gas within the first respectively the inlet chamber 5, which is formed between the chamber partition wall element 15*a* and the positioning portion 30 (not shown here) bypasses the chamfer 12*a* of the first chamber partition wall element 15*a* and is guided into the chamber 5, which is formed between the chamber partition wall element 15*a* and the chamber partition wall element 15*b*. Here, the flow path P is again deflected virtually by 90°, in order to get to the other side of the chamber 5 (that is, in the firing direction to the right from longitudinal axis $L_M$), in order to subsequently flow past chamfer 12*b* of the chamber partition wall element 15*b* into the next chamber 5, which is formed between the chamber partition wall element 15*b* and the chamber partition wall element 15*c*, wherein again a deflection of approximately 90° occurs.

In the chamber 5 being formed between the chamber partition wall element 15*b* and the chamber partition wall element 15*c*, the flow of the explosive gases is again deflected approximately by 90° in order to subsequently reach the other side of the chamber again (i.e., the left side of chamber 5, as viewed in the firing direction), in order that the flow may bypass the chamfer 12*c* of the chamber partition wall element 15*c* and flow into the further chambers, which are formed by the second center portion section 10*b*, if applicable. Also, in this case, a deflection of approximately 90° occurs etc.

In this manner, the dotted meandering or meander-shaped flow path P for the explosive gas is formed. A portion of the gas may or will also flow through the respective shoot-through openings; however, this portion is less relevant for the sound insulation.

Figure 5:
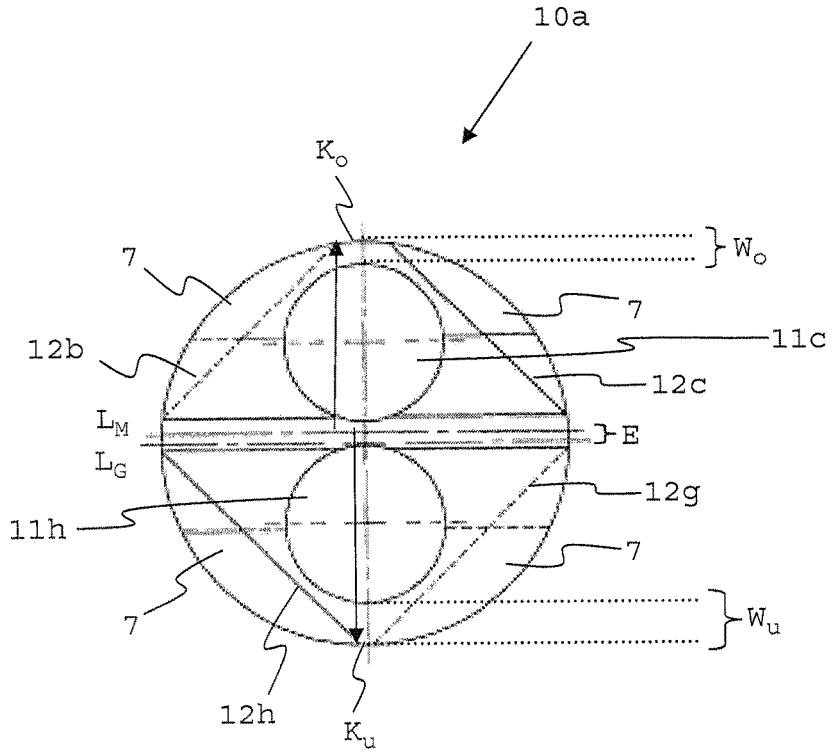
FIG. 5 shows a back view of the first center portion section according to FIG. 2.

In the back view of the first center portion section 10*a* shown in FIG. 5, one can initially recognize again the eccentricity E and the design of the upper edge $K_o$ and of the lower edge $K_u$ of the respective upper and lower chamber partition wall elements 15*c* and 15*h* corresponding therewith. The solid line on the top right corresponds to the lateral chamfer 12*c* of the chamber partition wall element 15*c* which forms a lateral passage 7 with the—in the mounted state—circumferentially surrounding housing part inner wall. At the top left, the lateral chamfer 12*b* of the chamber partition wall element 15*b* is shown with a dashed line, which again forms a lateral passage 7 with the—in the mounted state—circumferentially surrounding housing inner wall.

On the lower side, likewise it is provided that the solid line (bottom left) illustrates the lateral chamfer 12*h* of the chamber partition wall element 15*h*, which forms a lateral passage 7 with the imaginary housing portion inner wall. Finally, the dashed line at the bottom right represents the lateral chamfer 12*g* of the chamber partition wall element 15*g* which again forms a lateral passage 7 with the imaginary housing portion inner wall.

Figure 6:
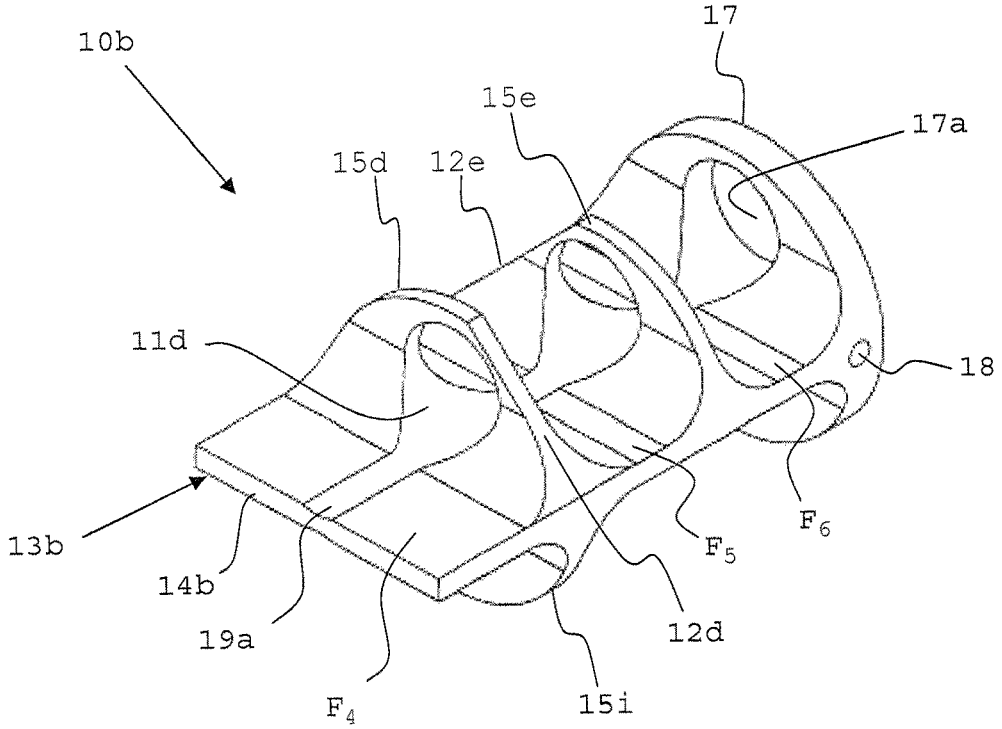
FIG. 6 shows a perspective view of a second center portion section for an inventive silencer device.

Next, with reference to FIG. 6, the second center portion section 10*b* is described, respectively. The longitudinal base element 13*b* of the second center portion section 10*b* includes again a narrow side 14*b* as well as flat regions $F_4$, $F_5$ and $F_6$. The chamber partition wall element 15*d* is arranged between the flat regions $F_4$ and $F_5$. The chamber partition wall element 15*d* comprises a chamfer 12*d* on its right side (as viewed in the firing direction). The shoot-through opening 11*d* extends through the first chamber partition wall element 15*d* (i.e., for the shot load of a shotgun).

Groove 19*b* extends through the flat region $F_4$, the groove 19*b* merging into the lower region of the shoot-through opening 11*d* and which continues respectively. The groove 19*b* provides a precisely flush alignment of the shoot-through openings 11*d* and 11*e* and of the shoot-out openings 17*a* with the upper barrel of the firearm (as well as the respective shoot-through openings of the first center portion section 10*b*) when the positioning portion 30, or the silencer device 1 as a whole, has been put onto the muzzle of the firearm (the same applies analogously for the lower barrel of the firearm and the underside of the second center portion section 10*b*).

The further chamber partition wall element 15*e* comprises a chamfer 12*e*, wherein the lateral chamfers 12*d* and 12*e* are arranged alternatingly, that is, as viewed in the firing direction, first right then left. The chamber partition wall element 15*d* comprises the shoot-through opening 11*d* and the chamber partition wall element 15*e* comprises the shoot-through opening 11*e*.

The rear-most chamber partition wall element of the second center portion section 10*b* is designed in the form of an end wall element 17, which comprises respective shoot-out openings 17*a* and 17*b* (for the lower barrel, not visible here). The end wall element 17 does not comprise lateral chamfers but is provided in order to terminate in a flush manner with the inner wall 21 of the housing portion at the front "shoot-out end". The end wall element 17 and the chamber partition wall elements 15*e* and 15*j* thereby form the terminal chamber 5 of the silencer device 1, respectively.

The shoot-through openings 15*d*, 15*e*, 15*i* and 15*j* of the chamber partition wall elements 11*d*, 11*e*, 11*i* and 11*j* are respectively aligned flush with one another as well as with the shoot-out openings of the end wall element 17. The chamber partition wall elements 15*d* and 15*e* (as well as the lower chamber partition wall elements 15*i* and 15*j*) respectively comprise again arcuately rounded foot regions R, which respectively merge into the flat regions $F_4$ respectively $F_5$.

The longitudinal base element 13*b* of the second center portion section 10*b* is inserted with its narrow side 14*b* into the recess 16 on the back side of the first center portion section 10*a*.

For each of the upper chamber partition wall elements, the substantially corresponding chamber partition wall elements 15*i* and 15*j* are provided on the underside of the longitudinal base element 13*b*, of which only the chamber partition wall element 15*j* is shown here.

This is again because the lateral chamfer 12*j* of the lower chamber partition wall element 15*j*, which cannot be seen, is arranged on the right side, since also here the chamfers are arranged alternatingly, and again oppositely alternating with regard to the lateral chamfers 12*d* and 12*e* of the chamber partition wall elements 15*d* and 15*e* on the upper side of the longitudinal base element 13*b*.

Figure 7:
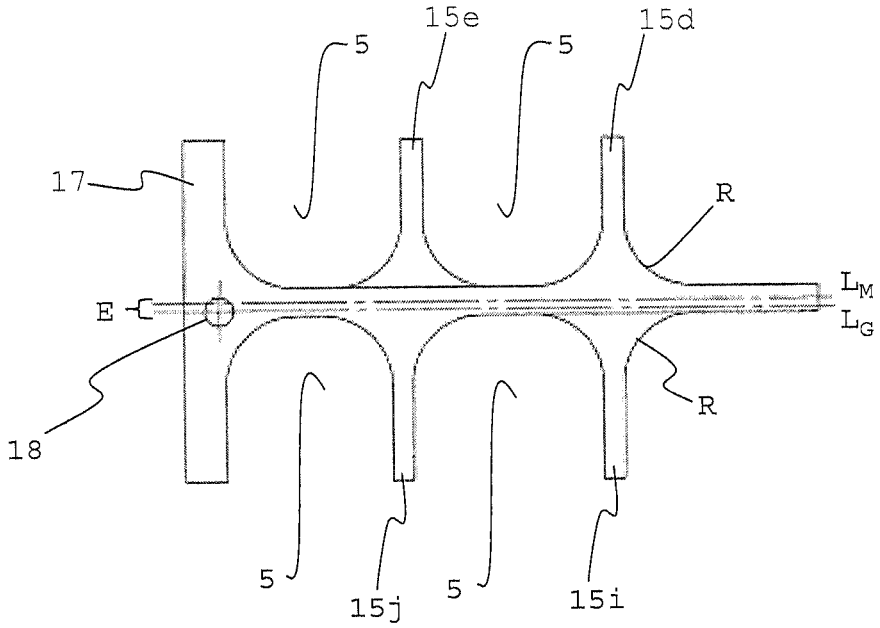
FIG. 7 shows a side view of the second center portion section according to FIG. 6.

FIG. 7 illustrates a side view of the second center portion section 10*b*. Here, one recognizes in particular on the underside of the longitudinal base element 13*b* the lower chamber partition wall elements 15*i* and 15*j*. The chamber partition wall element 15*i* is arranged opposite from the upper chamber partition wall element 15*d*. The chamber partition wall elements 15*e* and 15*j* are in contrast (in the longitudinal direction) slightly offset from one another, wherein in particular the chamber partition wall element 15*j* is slightly offset to the left, that is, in the direction of the end wall element 17. As a result, the chamber 5 formed between the end wall element 17 and the chamber partition wall element 15*j* is smaller than the chamber 5 formed between the end wall element 17 and the chamber partition wall element 15*e*.

Correspondingly, the chamber 5 which is formed between the chamber partition wall element 15*j* and the chamber partition wall element 15*i* is bigger than the chamber 5 which is formed between the chamber partition wall element 15*i* and the chamber partition wall element 15*d*. This is a preferred embodiment of the invention, which has proven to be advantageous in terms of fluid characteristics. Embodiments without a respective offset configuration of the chamber partition wall elements are conceivable.

Further, one may recognize again how the arcuately rounded-off foot regions R of the chamber partition wall elements merge into the respective flat regions (c.f. also FIG. 8 below).

Analogous to FIG. 3, one may also derive the eccentricity E from FIG. 7, namely from the distance between the longitudinal axis $L_M$ of the second center portion section 10*b* and the longitudinal axis $L_G$ of the housing portion 20.

Between the chamber partition wall elements 15*d* and 15*e* respectively 15*i* and 15*j*, as well as between the chamber partition wall elements 15*e* and 15*j* and the end wall element 17, chambers 5 are formed respectively, which together with the chamfers 12*d* and 12*e* or 12*i* and 12*j*, respectively, form the continuation of the upper as well as of the lower flow path P for the explosive gases, which due to their configuration, may provide for a particularly high sound insulation effect for the inventive silencer device 1.

Figure 8:
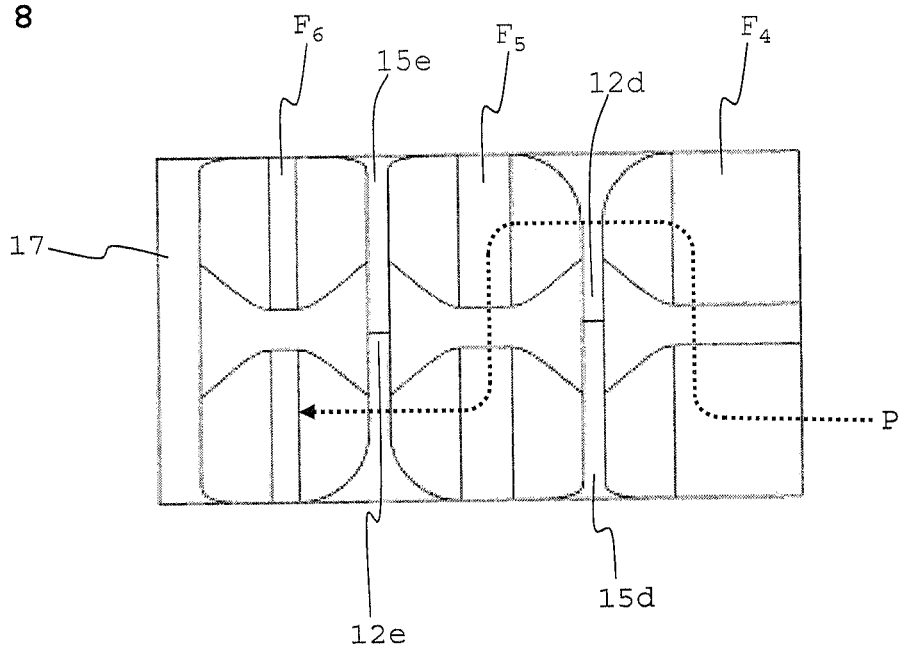
FIG. 8 shows a top view onto the second center portion section according to FIG. 6.

The continuation of the upper flow path P is shown schematically in FIG. 8 (a portion of the gas may or will flow also through the respective shoot-through openings, this portion is however less relevant for the sound insulation) by means of a top view on a second center portion section 10*b* of the inventive silencer device 1. The latter runs substantially analogous to FIG. 4 and discharges into chamber 5 being formed between the chamber partition wall element 15*e* and the end wall element 17. From here the explosive gas may flow to the outside through the shoot-out opening 17*a*.

Figure 9:
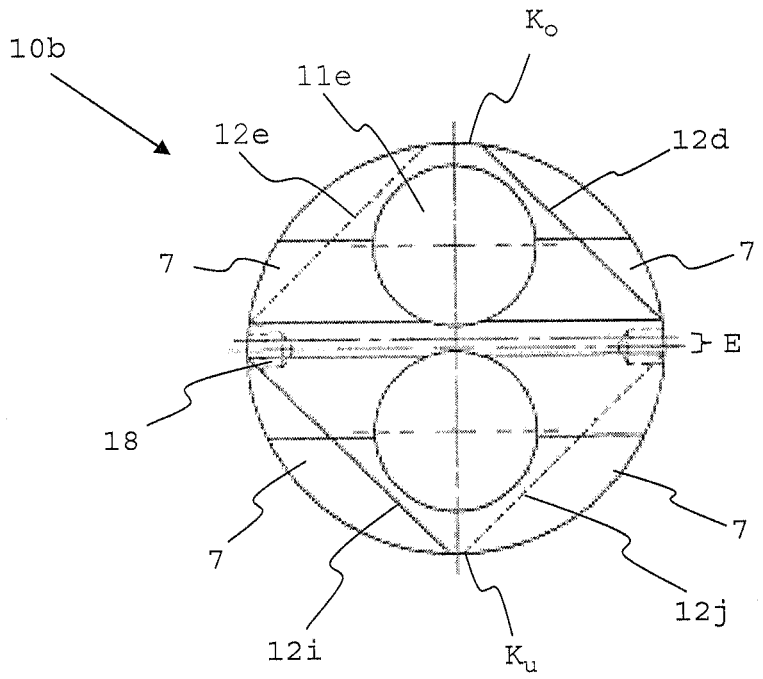
FIG. 9 shows a front view of the second center portion section according to FIG. 6.
Figure 10:
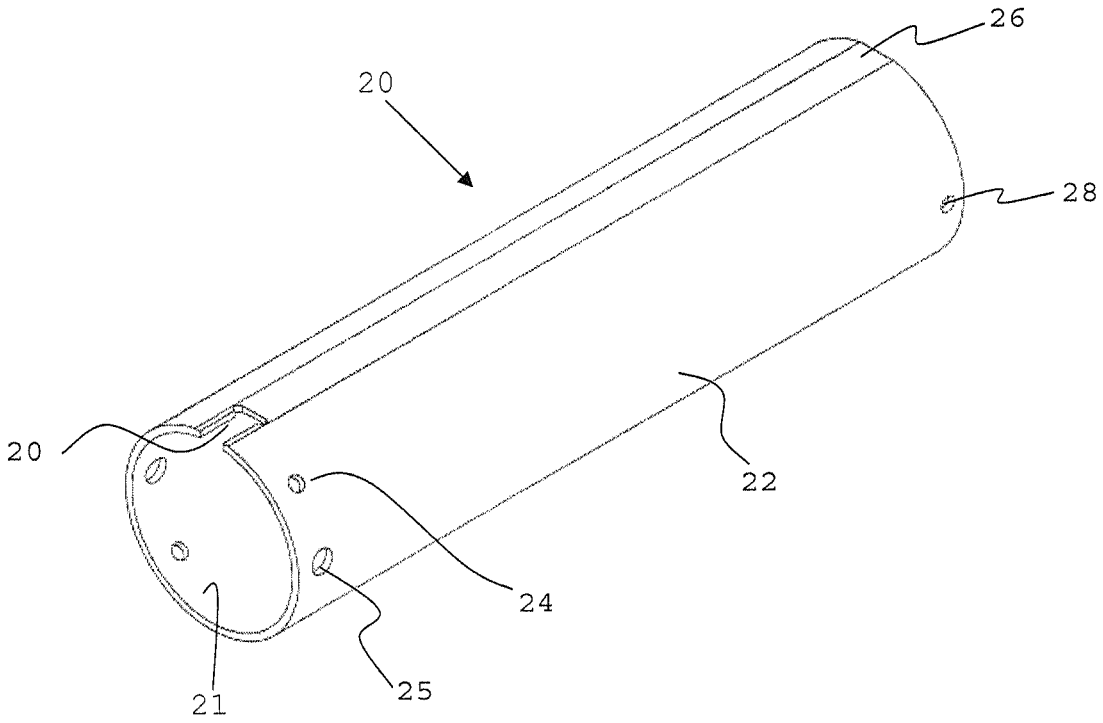
FIG. 10 shows a perspective view of a housing portion for an inventive silencer device.

In the front view according to FIG. 9 of the second center portion section is 10*b*, one may see again (analogous to FIG. 5) the eccentricity E and the corresponding design of the upper edge $K_o$ as well as of the lower edge $K_u$ of the upper and lower chamber partition wall elements 15*d*, 15*e* and 15*i*, 15*j* and of the end wall element 17.

The continuous line at the top right corresponds to the lateral chamfer 12*d* of the chamber partition wall element 15*d*, which forms together with the imaginary housing inner wall a lateral passage 7. At the top left, the lateral chamfer 12*e* of the chamber partition wall element 15*e* is shown with a dashed line, which again forms together a lateral passage 7 with the imaginary housing inner wall of the housing portion 20. On the lower side, likewise, the continuous line shown at the bottom left illustrates the lateral chamfer 12*i* of the chamber partition wall element 15*i*, which forms together with the imaginary housing inner wall of the housing portion a lateral passage 7. Finally, the dashed line shown at the bottom right represents likewise the lateral chamfer 12*j* of the chamber partition wall element 15*j*, which finally forms a lateral passage 7 with the imaginary housing portion inner wall.

FIGS. 10-13 illustrate the housing portion 20 of the inventive silencer device 1. Housing portion 20 comprises an outer housing wall 22 as well as an inner housing wall 21.

On the outside 22, a longitudinal flattening 26 is also provided, which merges into a recess 23 at the end of the housing portion 20 facing the firearm. The mounting bores 25 correspond to the mounting bores 35 of the positioning portion 30 and serve for eventually locking the inventive silencer device 1 at the muzzle of the respective firearm. The bores 24 correspond to the bore 34 in the positioning portion 30 and serve for a connection between these two components. The bores 28 again correspond with the bores 18 at the end wall element 17 of the second center portion section 10*b* and serve for a connection between these two components.

Figure 11:
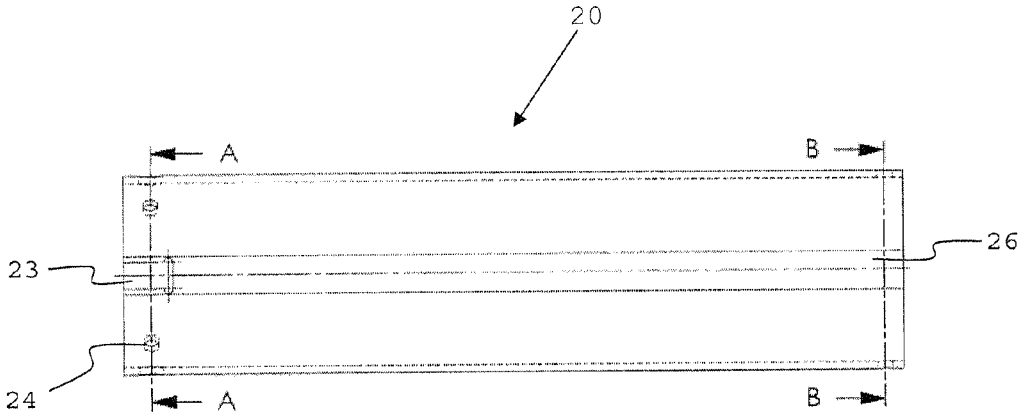
FIG. 11 shows a side view of the housing portion according to FIG. 10.
Figure 12:
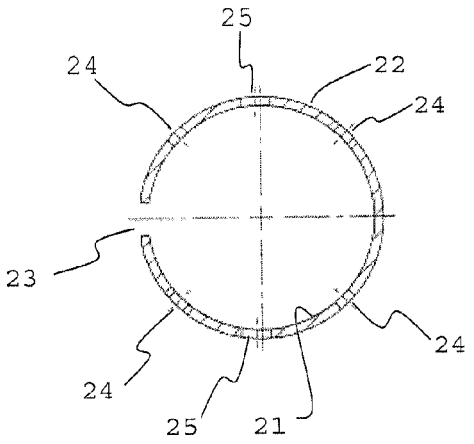
FIG. 12 shows a cross-sectional view of the housing portion along the line A-A according to FIG. 11.

FIG. 12 represents a sectional view along the line A-A in FIG. 11 and illustrates, amongst others, the recess 23 as well as the circumferential arrangement of the four bores 24 and of the two mounting bores 25.

Figure 13:
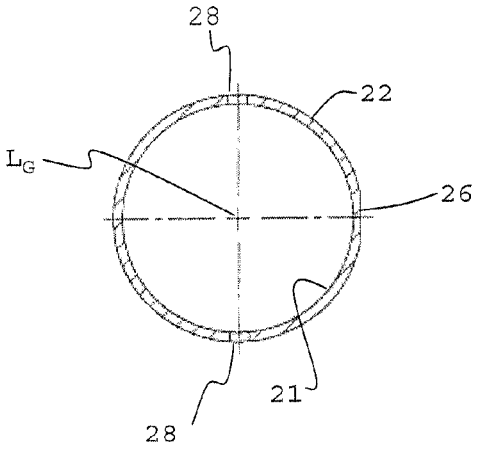
FIG. 13 shows a cross-sectional view of the housing portion along the line B-B according to FIG. 11.

FIG. 13 represents a sectional view along the line B-B in FIG. 11 and illustrates once again the design of the longitudinal flattening 26 on the outside 22 of the housing portion 20. One can see, in particular, that the longitudinal flattening 26 is only present at the outside 22 of the housing portion 20 but not at the inner wall 21 of the housing portion 20. Further, one can also see the bores 28, which, as already described above, correspond to the bores 18 in the end wall element 17 of the second center portion section 10*b*.

Figure 14:
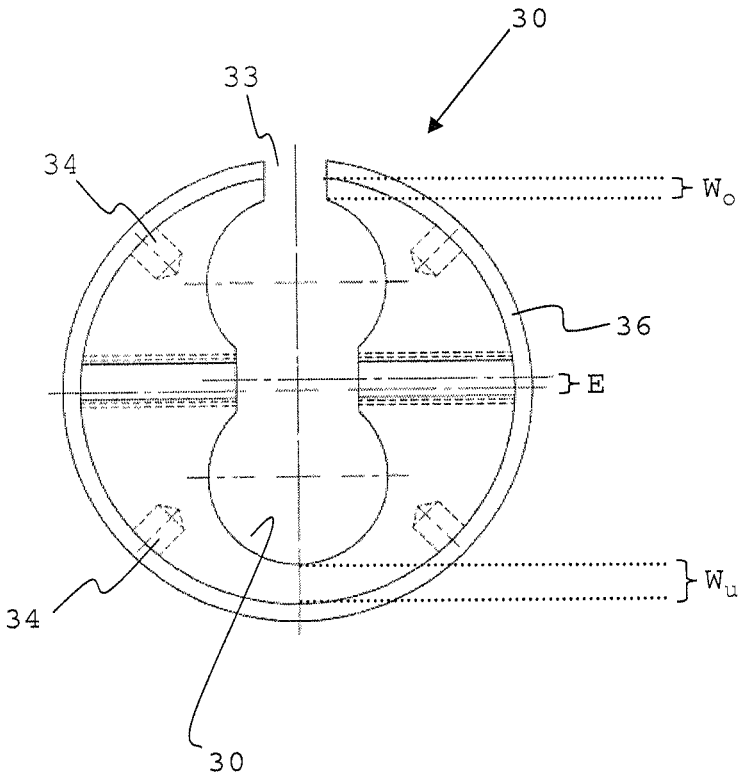
FIG. 14 shows a front view of a positioning portion for an inventive silencer device.
Figure 15:
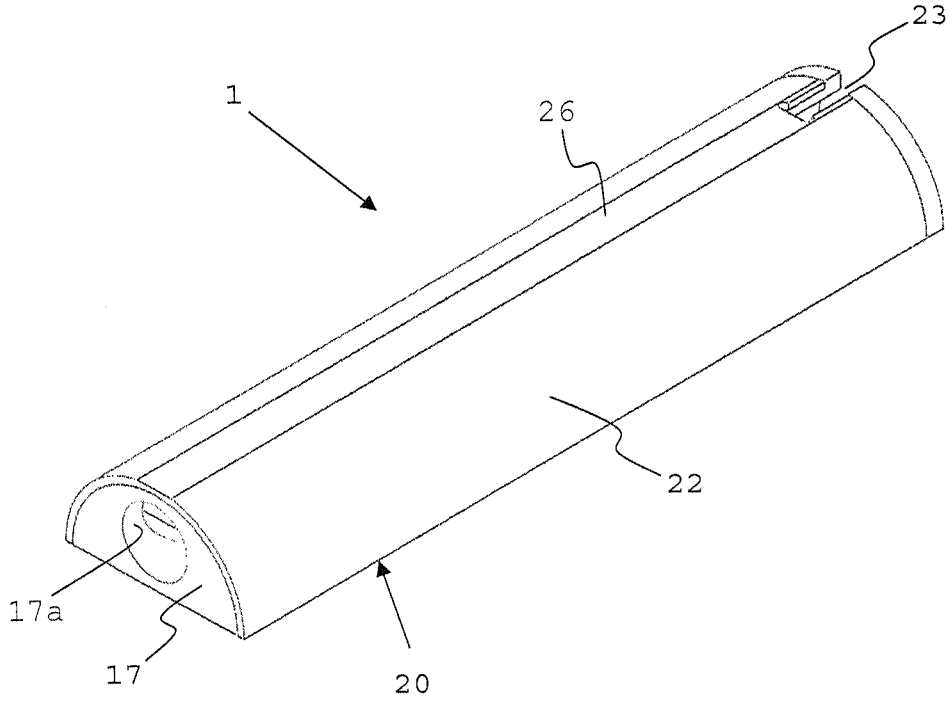
FIG. 15 shows a perspective view of an inventive silencer device for a firearm with one barrel.

Finally, in FIG. 14 a front view of a positioning portion 30 for an inventive silencer device (for a two-barrel firearm) is shown. One can see the flange ring 36, the bores 34 as well as the mounting opening 31 and the gap 33. The eccentricity E shown in FIGS. 5 and 9 may also be found at the positioning portion 30, respectively. As one can see, at the lower end of the positioning portion, the wall thickness $W_u$ from the lowermost point of the mounting opening 31 up to the flange ring 36 is bigger by the eccentricity E than the respective wall thickness $W_o$ at the upper end of mounting opening 31, which results from the gap 33, respectively the way the silencer device 1 is mounted at the firearm (and the target device of the latter).

In other words, in the case of barrels lying on top of each other (e.g. for an above-and-under shotgun) the lower chamber partition wall elements have to be formed with a bigger wall thickness on their underside, which corresponds to $W_u$, whereas the upper chamber partition wall elements only require a smaller wall thickness $W_o$, such that a flush alignment of the shoot-through openings 11 with the mounting opening 31, respectively with the firearm barrels may be achieved. The difference between $W_u$ and $W_o$ corresponds approximately to the eccentricity E. At this point, it is mentioned once again that this design represents a preferred embodiment and that also alternative embodiments of an inventive silencer device without eccentricity are conceivable.

FIGS. 15 to 18 illustrate a silencer device for a one-barrel firearm (e.g. a one-barrel shotgun). Thereby, the same reference numbers represent the same respectively analogous components. The respective housing portion 20, however, is formed in this embodiment semi-cylindrically. It includes again a longitudinal flattening 26 as well as a recess 23, which again corresponds to the gap 33 of the positioning portion 30.

The longitudinal flattening 26 is again located on top of the outside of the housing portion 20. At the front end of the silencer device 1, one can see the end wall element 17 with the shoot-out opening 17*a*. The respective bores for fastening the individual components to one another are omitted for the reason of straightforwardness.

Figure 16:
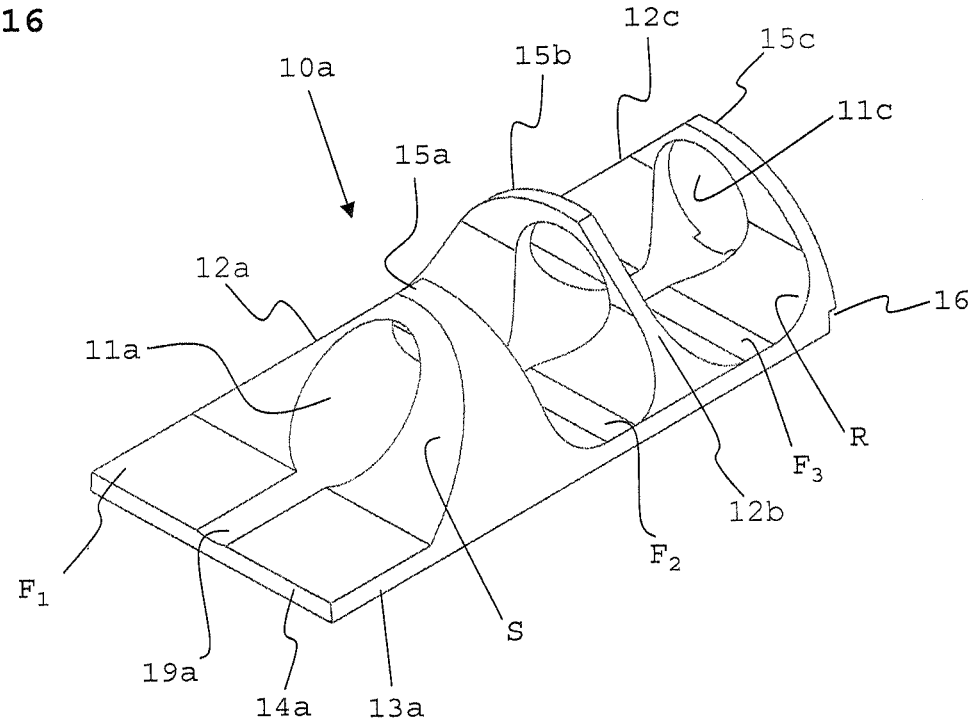
FIG. 16 shows a perspective view of a first center portion section for the silencer device according to FIG. 15.

The first center portion section 10*a* shown in FIG. 16 includes on the upper side of the longitudinal base element 13*a* three chamber partition wall elements 15*a*, 15*b* and 15*c*, which define the shoot-through openings 11*a*, 11*b* and 11*c*. Also here, the lateral chamfers 12*a*, 12*b* and 12*c* are arranged alternatingly, namely (as viewed in the firing direction) at first on the left, subsequently on the right and again on the left side of the first center portion section 10*a*.

At the front end one can see the flat region $F_1$ of the longitudinal base element 13*a* as well as the narrow side 14*a* of the latter and groove 19*a* extending through the flat region $F_1$, which again merges into the lower region of the shoot-through opening 11*a* and eventually again runs across the entire upper side of the first center portion section 10*a*, i.e. up to the recess 16*a* on the rear side of the chamber partition wall element 15*c*.

A flat region $F_2$ is arranged between the chamber partition wall elements 15*a*, 15*b* and a flat region $F_3$ is arranged between the chamber partition wall elements 15*b* and 15*c*. Also in this case, the foot regions of the chamber partition wall elements comprise arcuate roundings R, which merge into the flat regions $F_2$, $F_3$. On the side of the chamber partition wall element 15*a*, facing the positioning portion (in the mounted state), a slope S is again provided, which also in this case serves for dampening the back stroke of the arm, by absorbing the explosive gases in the first or inlet chamber in this way. Also here, an angle $\alpha$ between 30 and 60°, preferably 45° with the longitudinal base element 13*a* (not shown) is preferred in accordance with the above described embodiment.

Figure 17:
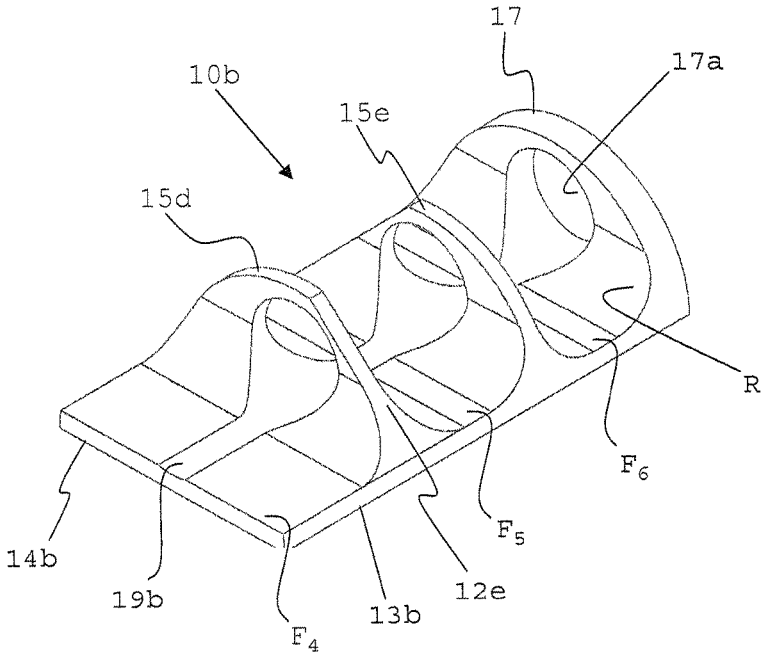
FIG. 17 shows a perspective view of a second center portion section for the silencer device according to FIG. 15.
Figure 18:
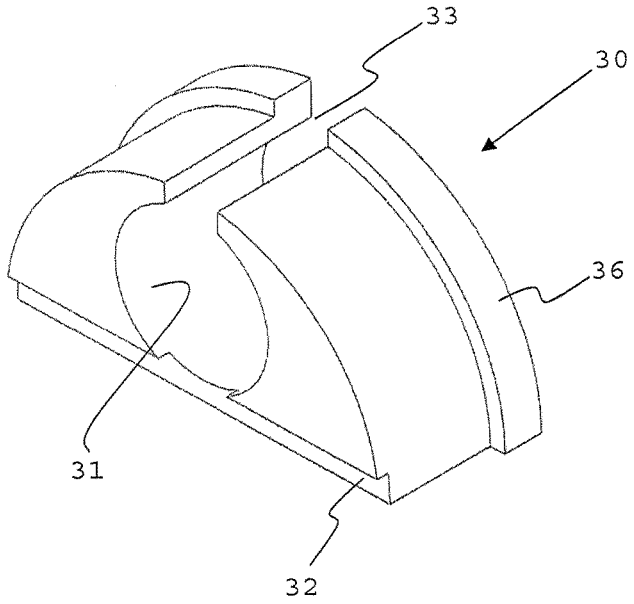
FIG. 18 shows a perspective view of a positioning portion for the silencer device according to FIG. 15.

In FIG. 17, a second center portion section 10b for a silencer device 1 for a one-barrel firearm is shown. The chamber partition wall elements 15*d*, 15*e* as well as the end wall element 17 protrude from the longitudinal base element 13*b*. The respective shoot-through openings 15*d*, 15*e*, or the shoot-out opening 17*a*, are aligned with one another in a flush manner (as well as with the other shoot-through openings of the first center portion section 10*a*). The flat region $F_5$ is formed between the chamber partition wall elements 15*d* and 15*e*, and the flat region $F_6$ is formed between the chamber partition wall element 15*e* and the end wall element 17. On the front side of the chamber partition wall element 15*d*, a flat region $F_4$ is arranged having a groove 19*b* which again runs across the second center portion section 10*b*, respectively. The narrow side 14*b* of the longitudinal base element 13*b* is also in this case provided for a mounting into the corresponding recess 16 of the first center portion section 10*a*.

The recess 32 of the positioning portion 30 shown in FIG. 18 again serves for receiving and mounting the narrow side 14*a* of the first center portion section 10*a*. The longitudinal base elements 13*a* and 13*b* therefore form the bottom of the silencer device for a one-barrel firearm. The housing portion 20 again terminates in a flush manner with the positioning portion, respectively the flange ring 36. The respective bores as well as the mounting bore for fastening the silencer device at the muzzle are omitted for reasons of straightforwardness.

The specification incorporates by reference the disclosure of EP 15 000 400.0, filed Feb. 11, 2015.

The present invention is, of course, in no way restricted to the specific disclosure of the specification and drawings, but also encompasses any modifications within the scope of the appended claims.

LIST OF REFERENCE NUMBERS

1 silencer device
5 chambers
7 lateral passages

10 center portion
10*a* first center portion section
10*b* second center portion section
11*a-j* shoot-through openings
12*a-j* chamfers
13*a* longitudinal base element (first center portion section)
13*b* longitudinal base element (second center portion section)
14*a* narrow side of the longitudinal base element
14*b* narrow side of the longitudinal base element
15*a-j* chamber partition wall elements
16 recess
17 end wall element
17*a* shoot-out opening
18 bores
19*a* groove (first center portion section)
19*b* groove (second center portion section)
20 housing portion
21 housing portion inner wall
22 housing portion outside
23 recess
24 bores
25 bores
26 longitudinal flattening
28 bores
30 positioning portion
31 mounting opening
32 recess
33 gap
34 bores
35 mounting bores
36 flange ring
$\alpha$ angle
E eccentricity
$F_1$-$F_6$ flat regions
$K_o$ upper edge
$K_u$ lower edge
$l_1$ length
$l_2$ length
$L_M$ longitudinal axis center portion section
$L_G$ longitudinal axis housing portion
P flow path
R arcuate roundings
S slope
$W_o$ wall thickness top
$W_u$ wall thickness bottom

We claim:

1. A silencer device for a firearm, comprising:

a center portion including at least two substantially semi-circular chamber partition wall elements being spaced from one another in the longitudinal direction of the center portion, the chamber partition wall elements respectively comprising shoot-through openings, wherein the shoot-through openings are correspondingly aligned with one another;

a housing portion into which the center portion is introduced, wherein at least one chamber is formed between the at least two substantially semi-circular chamber partition wall elements and the inner wall of the housing portion; and a positioning portion being at least connectable to the housing portion, wherein the at least two substantially semi-circular chamber partition wall elements, respectively, comprise on the outside at least one chamfer, wherein the at least one chamfer respectively together with the inner wall of the housing portion forms a lateral passage for explosive gases, wherein the chamber partition wall elements are contiguous with the housing portion with the exception of the at least one chamfer, and wherein the center portion comprises a longitudinal, plate shaped based element, wherein the substantially semi-circular chamber partition wall elements protrude from the longitudinal plate-shaped base element, wherein the lateral passages are arranged alternatingly, and wherein the alternatingly arranged lateral passages and the at least one chamber are positioned to form a meander-shaped flow path for the explosive gases.

2. The silencer device according to claim 1, wherein the positioning portion is lockable on a muzzle of the firearm.

3. The silencer device according to claim 1, wherein the chamber partition wall element directly facing the positioning portion comprises, at least in sections, a thicker wall than the other chamber partition wall elements.

4. The silencer device according to claim 3, wherein the wall is formed as a slope.

5. The silencer device according to claim 4, wherein the slope is arranged on the side of the chamber partition wall element facing the positioning portion.

6. The silencer device according to claim 5, wherein, viewed in cross-section, the slope forms an angle $\alpha$ of 30° to 60° with the longitudinal base element of the center portion.

7. The silencer device according to claim 6, wherein, viewed in cross-section, the stop forms an angle of approximately 45° with the longitudinal, plate-shaped base element of the center portion.

8. The silencer device according to claim 1, wherein the housing portion comprises a longitudinal flattening on its outer side.

9. The silencer device according to claim 1, wherein the positioning portion comprises on a side facing the center portion a recess which serves for receiving a narrow side of the longitudinal, plate-shaped base element of the center portion.

10. The silencer device according to claim 1, wherein the positioning portion is formed flange-like in order to enable a flush attachment of the housing portion.

11. The silencer device according to claim 1, wherein the positioning portion comprises a mounting opening.

12. The silencer device according to claim 11, wherein the mounting opening is in the shape of an open eight.

13. The silencer device according to claim 1, wherein the center portion comprises an end wall element at its end facing away from the positioning portion, said end wall element having a shoot-out opening, wherein said shoot-out opening is correspondingly aligned with the shoot-through openings of the at least two chamber partition wall elements.

14. The silencer device according to claim 13, wherein the end wall element of the center portion comprises bores, wherein said bores correspond with bores at the end of the housing portion facing away from a muzzle of the firearm.

15. The silencer device according to claim 1, wherein positioning portion comprises bores which correspond with bores at the end of the housing portion facing a muzzle of the firearm, and wherein the positioning portion further comprises mounting bores, wherein the positioning portion is lockable on the muzzle of the firearm via said mounting bores.

16. The silencer device according to claim 1, wherein the chamber partition wall elements, the end wall element and the positioning portion form, with the inner wall of the housing portion, a total of two to ten chambers.

17. The silencer device according to claim 1, wherein the chamber partition wall elements, the end wall element and the positioning portion form, with the inner wall of the housing portion, a total of four to eight chambers.

18. The silencer device according to claim 1, wherein the chamber partition wall elements, the end wall element and the positioning portion form, with the inner wall of the housing portion, a total of six chambers.

19. The silencer device according to claim 1, wherein the firearm is a shotgun.

* * * * *